United States Patent [19]

Hänsch

[11] 4,307,801

[45] Dec. 29, 1981

[54] CONVEYOR APPARATUS FOR SUBSTANTIALLY FLAT PRODUCTS, ESPECIALLY PRINTED PRODUCTS

[75] Inventor: Egon Hänsch, Wetzikon, Switzerland

[73] Assignee: Ferag AG, Hinwil, Switzerland

[21] Appl. No.: 117,106

[22] Filed: Jan. 31, 1980

[30] Foreign Application Priority Data

Mar. 8, 1979 [CH] Switzerland ..... 2229/79

[51] Int. Cl.[3] ..... B65G 47/86

[52] U.S. Cl. ..... 198/695; 101/411; 198/479; 198/696; 271/204; 294/116

[58] Field of Search ..... 198/429, 486, 650, 653, 198/695, 696; 294/104, 106, 116, 118; 226/173; 209/903; 271/204, 277; 101/408–411

[56] References Cited

U.S. PATENT DOCUMENTS 2,092,189 9/1937 Stobb ..... 101/410

FOREIGN PATENT DOCUMENTS 109330 11/1974 German Democratic Rep. ..... 198/404

2024176 1/1980 United Kingdom ..... 271/204

*Primary Examiner*—Robert B. Reeves

*Assistant Examiner*—Douglas D. Watts

*Attorney, Agent, or Firm*—Werner W. Kleeman

[57] ABSTRACT

Each of both clamping jaws of a product gripper are formed by a holder portion and an extension portion formed of one-piece with the related holder portion. Both of the holder portions are held in their closed position by means of a closure spring. The clamping jaws are conjointly pivotable about a shaft which simultaneously serves as the pivot shaft for the hinge connection between both of the clamping jaws. If the product gripper is rocked into a product receiving position, then the extension portion of one clamping jaw is located at one side of a stop in contact therewith. For opening the gripper there is exerted an opening force upon the extension portion of the other clamping jaw, so that the related holder portion is raised from the other holder portion against the force of the closure spring. For releasing the seized product the clamping jaws are rocked in clockwise direction into their product release position where the extension portion of the other clamping jaw bears against the stop. Under the action of an opening force exerted upon the extension portion of said one clamping jaw and holder portion of such one clamping jaw is raised, against the action of the closing spring, from the holder portion of the other clamping jaw.

13 Claims, 6 Drawing Figures

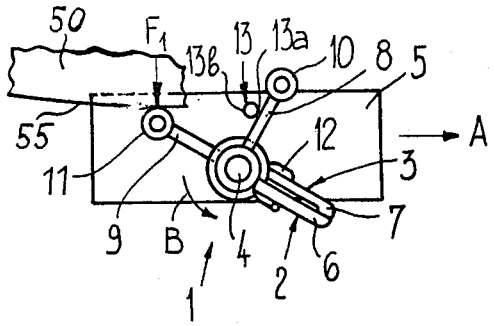
Fig. 1
Fig. 2
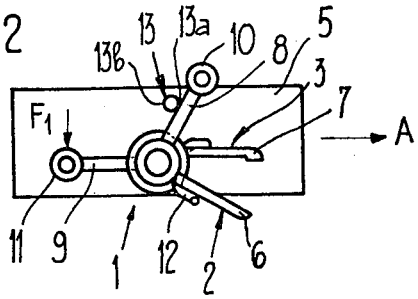
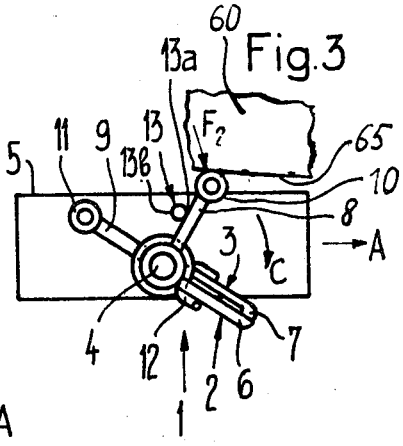
Fig. 3
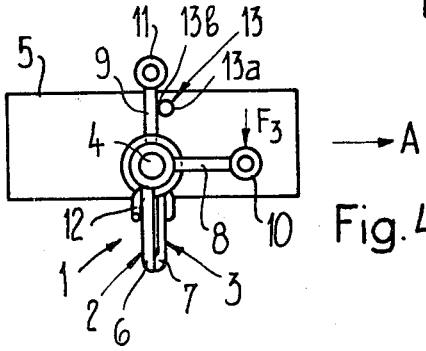
Fig. 4
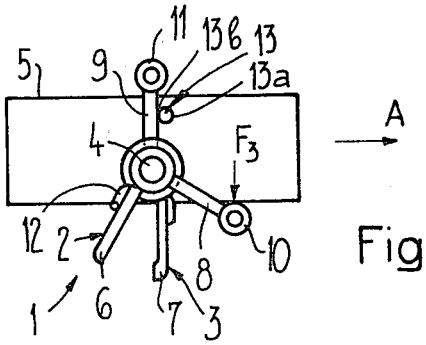
Fig. 5

CONVEYOR APPARATUS FOR SUBSTANTIALLY FLAT PRODUCTS, ESPECIALLY PRINTED PRODUCTS

CROSS-REFERENCE TO RELATED CASES

The assignee of this application is the owner of U.S. Pat. No. 4,039,182, granted Aug. 2, 1977, U.S. Pat. No. 4,072,228, granted Feb. 7, 1978, U.S. application Ser. No. 908,538, filed May 22, 1978 now U.S. Pat. No. 4,201,286 U.S. application Ser. No. 51,344, filed June 25, 1979, and U.S. application Ser. No. 110,822, filed Jan. 10, 1980, entitled "Apparatus For Infeeding Flat Products, Especially Printed Products, Arriving In An Imbricated Stream To a Transport Device".

BACKGROUND OF THE INVENTION

The present invention relates to a new and improved construction of conveyor apparatus for conveying essentially flat products, especially printed products.

Generally speaking, the conveyor apparatus of the present development is of the type comprising a number of grippers secured at a mutual spacing from one another at a traction element, each gripper having two clamping jaws. These clamping jaws of each gripper are held in a closed position under the action of a closing force and in this position the clamping jaw retains therebetween one or more printed products.

Such type conveyor apparatus is known for instance from German Patent Publication No. 2,519,561 and the corresponding U.S. Pat. No. 3,955,667. The grippers of this transport equipment assume, with respect to the conveying direction, always the same position which is directed rearwardly. This position is retained both during product reception, product transport and release or outfeed of the products.

SUMMARY OF THE INVENTION

It is a primary object of the present invention to provide a new and improved construction of conveyor apparatus of the previously mentioned type wherein it is possible to change the position of the grippers with respect to the conveying direction.

Yet a further significant object of the present invention aims at a new and improved construction of conveyor apparatus for substantially flat products, especially printed products, which is relatively simple in construction and design, economical to manufacture, extremely reliable in operation, not readily subject to breakdown or malfunction, and requires a minimum of maintenance and servicing.

A still further object of the present invention aims at providing a new and improved construction of conveyor apparatus for substantially flat products, wherein the product grippers can be selectively positioned with respect to the direction of conveying of the products, to thereby provide for a more versatile operation of the conveyor apparatus.

Now in order to implement these and still further objects of the invention, which will become more readily apparent as the description proceeds, the conveyor apparatus of the present development is manifested by the features that the clamping jaws are conjointly pivotable about a shaft between two impact or stop positions, wherein each respective one of the stop positions coacts with one of both clamping jaws. Further, there is provided an opening device which, in each case, when one of the clamping jaws impacts against the related stop or impact location acts upon the other clamping jaw and raises the latter against the closing force from the first-mentioned clamping jaw.

The product reception position and release position of the grippers, each of which is governed by one of the related stop or impact locations, deviate from one another and this, in turn, enables selecting the infeed direction of the products to be seized with respect to the conveying direction of the grippers different than the outfeed direction of the products which are outfed or delivered by the grippers. Thus, it is for instance possible to seize the infed products by means of the grippers which are directed forwardly with respect to the conveying direction and to release the thus seized product by means of grippers which are directed rearwardly.

Now in East German Pat. No 109,330, there is taught to the art an apparatus for turning rods. This prior art apparatus consists of a number of stationary, adjacently arranged turning devices which are synchronously driven by means of a common shaft. Each turning device contains two clamping jaws which are pivotable about a common shaft, these clamping jaws being retained in their closed position by the action of spring force. To open the clamping jaws there are provided stops at the end positions of the pivotal movement, against which there come to bear in each case a clamping jaw, whereas by further rotating the other clamping jaw such is opened from the clamping jaw bearing against its stop. This state-of-the-art equipment serves however, as already mentioned, for turning circular rods through 180° and not for conveying essentially flat products, such as for instance printed products.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 schematically illustrates an exemplary embodiment of conveyor apparatus showing one of the product grippers with its clamping jaws and related holder, the gripper being shown in a first position;

FIG. 2 illustrates the conveyor apparatus of FIG. 1 with one clamping jaw thereof being opened;

FIG. 3 illustrates the conveyor apparatus of FIG. 1 with the clamping jaws of the gripper in the process of being rocked towards another possible position;

FIG. 4 illustrates the completion of movement of the clamping jaws of the gripper which is in the process of berocked or pivoted as shown in FIG. 3;

FIG. 5 illustrates opening of the other clamping jaw of the gripper which has assumed the position shown in FIG. 4; and FIG. 6 illustrates the conveyor apparatus of the invention with a plurality of grippers attached in spaced relationship from one another at a traction element.

DETAILED DESCRIPTION OF THE PREFERRED EMBODIMENTS

Describing now the drawings, it is to be understood that to simplify the illustration only enough of the construction of the conveyor apparatus of the present development has been shown to enable those skilled in the art to readily understand the underlying principles and concepts of the invention. Turning attention now to FIGS. 1 to 5, there is illustrated therein, by way of example, one of the product grippers 1 which is attached along with other similar type grippers, as in the showing of FIG. 6, at a not particularly illustrated, but conventional revolvingly driven traction element, for instance a conveyor chain as is well known in this technology. Each of these grippers 1 comprises two clamp or clamping jaws 2 and 3 which are rotatably mounted upon a shaft 4 which is secured to a holder or holder means 5. By means of this holder 5 the gripper 1 is connected with the previously mentioned traction element. The clamping jaws 2 and 3 are formed by the respective holder portions 6 and 7 and the extension portions 8 and 9, respectively, formed of one-piece with the related holder portion. Each of these extension portions 8 and 9 carries at its free end a control roll or follower 10 and 11 which coacts with control means, for instance as schematically illustrated control cams 50 and 60 (FIGS. 1, 3 and 6) in a manner still to be described more fully hereinafter.

The extension portion 8 of the clamping jaw 2 forms together with the holder portion 6 of such clamping jaw 2 approximately a right-angle, whereas the extension portion 9 of the other clamping jaw 3 is in alignment with its related holding or holder portion 7. Both of the clamping jaws 2 and 3 are retained in their closed position by means of a spring 12 or other suitable biasing means which engage at both of the holder portions 6 and 7. In the closed position of both of the holder portions 6 and 7 they fixedly clamp therebetween one or more products which are being conveyed. Both of the clamping jaws 2 and 3 are conjointly pivotable about the shaft 4 and are hingedly interconnected by means of this shaft 4, so that both of the clamping jaws 2 and 3 can be opened by overcoming the applied force of the closing spring 12, in a manner which will be described more fully hereinafter. To limit the conjoint pivotal movement of both clamping jaws 2 and 3 there is attached a stop or impact member 13 at the holder 5, this stop 13 having two oppositely situated stop or impact locations 13*a* and 13*b* for the extension portion 8 and the extension portion 9, respectively. In the description to follow there will now be considered the mode of operation of this gripper.

In the showing of FIG. 1 the gripper is illustrated in its product receiving position, where it is rocked, during its movement in the conveying direction A, by the action of the control device or means 50, for instance the schematically illustrated cam of the showing of FIGS. 1 and 6, which coacts with the control roll or follower 11 and causes a common rocking of both clamping jaws 2 and 3 in the direction of the arrow B. This common rocking of both clamping jaws 2 and 3 is terminated upon impact of the extension portion 8 of the clamping jaw 2 at the impact or stop location 13*a* of the stop or impact member 13. The product receiving position of the gripper 1 is therefore fixed by this stop or impact location 13*a*.

To open the gripper 1 for the purpose of seizing or grasping a nonillustrated printed product there is effective at the control roll or cam follower 11 an opening device, for instance a cam, generally indicated by reference character 55, which exerts an opening force $F_1$ upon the control or follower roll 11. This opening device 55 is advantageously subsequently formed at the control device 50 for the common pivoting or rocking of the gripper 1, so that the control cam portions of the control device 50 and the opening device 55 merge with one another.

Now as best seen by referring to FIG. 2 this opening force $F_1$ causes rotation of the clamping jaw 3 with respect to the clamping jaw 2 which bears against the stop or impact member 13 about the common pivot shaft 4. Consequently, the holder portion 7 of the clamping jaw 3 is raised, against the action of the closing spring 12, from the holder portion 6 of the clamping jaw 2. Now it is possible for one or a number of printed products to travel into the holder portions 6 and 7 which have been opened in the described manner. Now the opening device 55 again frees the control roll 11 which, in turn, enables the closure spring 12 to again rotate the clamping jaw 3 back into the closed position, so that the printed product or products are fixedly clamped between both of the holder portions 6 and 7.

Due to the inherent weight of the product fixedly clamped between the clamping jaws 2 and 3 it is possible for both of the clamping jaws 2 and 3 to pivot upon the shaft 4 to such an extent until the product depends downwardly. FIG. 3 shows the gripper 1 still in the product receiving position after having seized a printed product. In order to rock the gripper 1 out of this product receiving position in the direction of the arrow C there is exerted a force $F_2$ by the control device 60, for instance a control cam, upon the control roll 10 of the clamping jaw 2, which force acts in addition to or instead of the force which is produced by the printed product fixedly retained between the holder portions 6 and 7. Due to the application of this force $F_2$ there is produced a rotational moment or torque, by means of which the gripper 1 is rocked from the product receiving position into the product release position, the latter having been shown in FIG. 4. In this product release position the extension portion 9 of the clamping jaw 2 bears against the stop or impact location 13*b* of the stop or impact member 13, thereby preventing any further rotation of the gripper 1 in the direction of the arrow C. In order to open the clamping jaws 2 and 3 the clamping jaw 2 is rotated about the shaft 4, as shown in FIG. 5, by the action of an opening device, generally indicated by reference character 65 in FIG. 3. This schematically illustrated opening device 65, which likewise may be in the form of a cam, acts upon the control roll 10 provided at the extension portion 8 and exerts upon such control roll 10 an opening force generally designated by reference character $F_3$. By means of this opening force $F_3$ the extension portion 8 together with the holder portion 6 is rotated about the shaft 4 in the direction of the arrow C. As a result there is accomplished a lifting-off of the holder portion 6 from the holder portion 7, and thus, a release of the previously seized product. As already described in conjunction with the disclosure of the conveyor apparatus based upon FIGS. 1 and 2, this opening device 65 can merge at the control device 60 for the conjoint pivoting of the clamping jaws 2 and 3 into the product release position.

As will be apparent from the previous description, in order to open the grippers 1 there is alternately applied to the one or the other clamping jaw 2 and 3, respectively, an opening force $F_3$ and $F_1$, respectively, whereas the other clamping jaw bears by means of its extension portion 8 or 9, as the case may be, at the stop or impact member 13, so that there is prevented any common further rotation of the clamping jaws 2 and 3. Each clamping jaw 2 and 3 remains stationary in the product receiving position or the product release position, as the case may be and is lifted off in the other position.

As best seen by referring to FIGS. 1 and 2, the clamping jaws 2 and 3, when in their product receiving position, are directed forwardly with respect to the product conveying direction A, whereas the clamping jaws 2 and 3, in the product release position, as shown in FIGS. 4 and 5, are downwardly directed. The direction of the clamping jaws 2 and 3 therefore can be differently chosen, depending upon their construction and the arrangement of the stop 13 in the product receiving position and the product release position and can be accommodated to the infeed direction of the products to be seized and the outfeed direction of the products which are to be released. With the illustrated exemplary embodiment the pivot angle of the clamping jaws 2 and 3 between the product receiving position and the product release position amounts to about 90°. However, it should be understood that depending upon the construction of the clamping jaws 2 and 3 and the arrangement of the stop or impact locations 13*a* and 13*b* it is also possible to select a larger or smaller pivot angle.

Instead of using a single stop or impact member 13, having two oppositely situated stop or impact locations 13*a* and 13*b*, and which is impacted at both sides thereof by the extension portions 8 and 9, it would also be possible to provide two mutually separated stops, wherein each stop has a stop location for one of both extension portions 8 and 9, as the case may be. These stops likewise are preferably secured to the holder 5 for the pivot shaft 4.

As already mentioned the gripper 1 in FIGS. 1 to 6 has only been purely schematically illustrated for explaining the basic construction and the mode of operation in accordance with the principles of the invention. Therefore, it is to be expressly understood that different constructions of gripper 1 are possible and will readily suggest themselves to those skilled in the art, beyond those disclosed herein by way of example. For instance, the one clamping jaw, for instance the clamping jaw 3, can be structured as a bipartite element. Both of the parts thereof can be conjointly or, however, also separately lifted off of the other clamping jaw by the action of the opening force.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. In a conveyor apparatus for substantially flat products, especially printed products, containing a number of grippers attached at a mutual spacing from one another at a traction element, wherein each gripper possesses two clamping jaws retained by a closing force in a closing position for fixedly retaining the products, the improvement which comprises:

a shaft provided for each gripper;

said shaft mounting said clamping jaws conjointly for pivotable movement thereabout between two stop locations;

stop means defining said two stop locations;

a respective one of the stop locations defined by said stop means coacting with a respective one of both clamping jaws;

at least two opening devices;

one of said opening devices acting upon one of said clamping jaws while the other clamping jaw is in contact with its related stop location defined by said stop means and lifts said one clamping jaw against the action of the closing force from the other clamping jaws; and the other of the opening devices acting upon said other clamping jaw while said one clamping jaw is in contact with its related stop location defined by said stop means and lifts said other clamping jaw against the action of the closing force from said one clamping jaw.

2. The conveyor apparatus as defined in claim 1, further including:

spring means for exerting a spring force for retaining both clamping jaws in their closed position.

3. The conveyor apparatus as defined in claim 1, wherein:

both of said clamping jaws are hingedly interconnected with one another.

4. The conveyor apparatus as defined in claim 3, wherein:

the hingedly interconnected clamping jaws pivot about a pivot axis which is formed by the pivot shaft of the two clamping jaws.

5. In a conveyor apparatus for substantially flat products, especially printed products, containing a number of grippers attached at a mutual spacing from one another at a traction element, wherein each gripper possesses two clamping jaws retained by a closing force in a closing position for fixedly retaining the products, the improvement which comprises:

a shaft provided for each gripper;

said shaft mounting said clamping jaws conjointly for pivotable movement thereabout between two stop locations;

means defining said two stop locations;

a respective one of the stop locations defined by said stop means coacting with a respective one of both clamping jaws;

an opening device which, when one of the clamping jaws comes into contact with said stop means defining its related stop location, acts upon the other clamping jaw and opens said other clamping jaw against the action of the closing force, from the first mentioned clamping jaw; and each clamping jaw containing an extension portion which imparts against said stop means defining its related stop location and upon which acts said opening device.

6. The conveyor apparatus as defined in claim 1, wherein:

said stop means defining said stop locations is formed by a stop.

7. The conveyor apparatus as defined in claim 6, further including:

holder means for the pivot shaft; and said stop being arranged at said holder means.

8. In a conveyor apparatus for substantially flat products, especially printed products, containing a number of grippers attached at a mutual spacing from one another at a traction element, wherein each gripper possesses two clamping jaws retained by a closing force in a closing position for fixedly retaining the products, the improvement which comprises:

a shaft provided for each gripper;

said shaft mounting said clamping jaws conjointly for pivotable movement thereabout between two stop locations;

means defining said two stop locations;

a respective one of the stop locations defined by said stop means coacting with a respective one of both clamping jaws;

an opening device which, when one of the clamping jaws comes into contact with said stop means defining its related stop location, acts upon the other clamping jaw and opens said other clamping jaw against the action of the closing force, from the first mentioned clamping jaw; and said stop means defining said stop locations being formed by a stop which is impacted at opposite locations thereof by a respective one of the clamping jaws.

9. The conveyor apparatus as defined in claim 8, further including:

holder means for the pivot shaft and at which there is arranged said stop.

10. The conveyor apparatus as defined in claim 1, wherein:

each said opening device comprises a control cam along which there are guided the clamping jaws to be opened.

11. The conveyor apparatus as defined in claim 1, wherein:

one of said clamping jaws is formed of two parts which can be lifted-off of the other clamping jaw.

12. The conveyor apparatus as defined in claim 11, wherein:

said two parts can be conjointly lifted-off of the other clamping jaw.

13. The conveyor apparatus as defined in claim 11, wherein:

said two parts can be independently lifted-off of the other clamping jaw.

* * * * *